US005613450A

United States Patent [19]

Wagner et al.

[11] Patent Number: 5,613,450

[45] Date of Patent: Mar. 25, 1997

[54] MOBILE FOLDING STAGE

[75] Inventors: Walter R. Wagner, Minneapolis; Richard C. Bue, Chaska, both of Minn.

[73] Assignee: Sico Incorporated, Minneapolis, Minn.

[21] Appl. No.: 337,254

[22] Filed: Nov. 10, 1994

[51] Int. Cl.[6] ..... A47B 3/083; E04H 3/28

[52] U.S. Cl. ..... 108/175; 108/170; 52/7

[58] Field of Search ..... 52/7; 108/113, 108/162, 166, 167, 170, 173, 175

[56] References Cited

U.S. PATENT DOCUMENTS

| | | | |
|---|---|---|---|
| Re. 24,454 | 4/1958 | Wilson | 52/7 X |
| 89,306 | 4/1869 | Goodher . | |
| 770,152 | 9/1904 | Bechtel . | |
| 1,370,732 | 3/1921 | Corbett . | |
| 2,508,627 | 5/1950 | Spiegel et al. . | |
| 2,514,524 | 7/1950 | Steele . | |
| 2,645,539 | 7/1953 | Thompson . | |
| 2,721,778 | 10/1955 | Wilson . | |
| 2,730,417 | 1/1956 | Mitchell . | |
| 2,739,860 | 3/1956 | Wilson . | |
| 2,747,958 | 5/1956 | Wilson . | |
| 2,764,460 | 9/1956 | Nelson . | |
| 2,766,089 | 10/1956 | Nielsen . | |
| 2,771,937 | 11/1956 | Wilson . | |
| 2,782,075 | 2/1957 | Fagan | 52/7 X |
| 2,792,270 | 5/1957 | Anderson | 108/170 |
| 2,831,741 | 4/1958 | Wilson . | |
| 2,873,157 | 2/1959 | Wilson . | |
| 2,969,245 | 1/1961 | Wilson . | |
| 2,977,169 | 3/1961 | Geller . | |
| 2,978,754 | 4/1961 | Wilson | 52/7 |
| 2,983,968 | 5/1961 | Wurn . | |
| 2,993,740 | 7/1961 | Good . | |
| 3,027,209 | 3/1962 | Nielsen . | |
| 3,028,197 | 4/1962 | Wilson . | |
| 3,075,809 | 1/1963 | Wilson . | |
| 3,080,833 | 3/1963 | Risdall . | |
| 3,099,480 | 7/1963 | Wilson . | |
| 3,143,982 | 8/1964 | Blink et al. . | |
| 3,245,363 | 4/1966 | Amthor et al. . | |
| 3,276,401 | 10/1966 | Wilson et al. . | |
| 3,337,262 | 8/1967 | Katzfey et al. . | |
| 3,351,029 | 11/1967 | Bue . | |
| 3,362,358 | 1/1968 | Farish, III | 108/170 |
| 3,437,058 | 4/1969 | Bue . | |
| 3,476,061 | 11/1969 | Takahashi . | |
| 3,557,720 | 1/1971 | Blink et al. . | |
| 3,799,073 | 3/1974 | Nielsen . | |
| 3,861,325 | 1/1975 | Bue et al. . | |
| 3,903,812 | 9/1975 | Cowley . | |
| 3,999,491 | 12/1976 | Wilson . | |
| 4,026,221 | 5/1977 | Wilson et al. . | |
| 4,054,096 | 10/1977 | Wilson et al. . | |
| 4,074,636 | 2/1978 | Wilson . | |
| 4,104,835 | 8/1978 | Bardwick, III . | |
| 4,133,271 | 1/1979 | Carlson . | |
| 4,232,488 | 11/1980 | Hanley . | |
| 4,327,650 | 5/1982 | Bue | 108/113 |

FOREIGN PATENT DOCUMENTS

| | | |
|---|---|---|
| 0389932 | 3/1990 | European Pat. Off. . |
| 2314315 | 6/1975 | France . |
| 2418319 | 2/1978 | France . |
| 2554476 | 11/1983 | France . |
| 2587784 | 9/1985 | France . |

OTHER PUBLICATIONS

"Sico Staging & Risers . . . Leading the Way." 4 Page Brochure by Sico Incorporated.

*Primary Examiner*—Michael Safavi

*Attorney, Agent, or Firm*—Merchant, Gould, Smith, Edell, Welter & Schmidt, P.A.

[57] ABSTRACT

A folding stage (20) includes a folding framework (22) supporting stage decks (24). The stage is supported on a caster frame (38) including casters (26) for moving the stage from location to location in a folded position. Inner legs (32) and outer legs (34) support the stage in the unfolded position and fold against decks (24) in the storage position. A folding linkage (30) directs and controls folding between a use position and a folded storage position.

22 Claims, 10 Drawing Sheets

MOBILE FOLDING STAGE

BACKGROUND OF THE INVENTION

1. Field of the Invention

The present invention relates to mobile elevationally adjustable folding stages which fold between a storage position and a use position.

2. Description of the Prior Art

Folding stages are used for a variety of purposes to provide a temporary raised platform for use in schools, hotels, convention centers and other institutions wherein multiple use facilities require the capability of setting up temporary stages. Such stages are made up of individual stage structures which are positioned adjacent each other to form extended stage surface. When not in use, the individual stage structures may be folded to compact dimensions and stored.

Stages which are used for forming an elevated platform at lower heights, typically ranging between stages having a minimum height of 16 inches and adjusting in increments of 6 or 8 inches, up to stages having a maximum height of 48 inches with lower height increments of 6 or 8 inches, generally fold at their center with a pair of stage decks having upper surfaces folding adjacent each other in a nearly vertical storage position. The folding linkage facilitates folding from a use position to the storage position. Support legs may fold inward to be substantially flush against the underside of the stage decks. When folded, the stages are supported on rollers or casters for moving between locations.

Although these stages have proven very useful at providing folding lower level staging, further improvements are possible. Such stages typically are only able to adjust between two heights due to the complexity of folding to a vertical position with the legs folding proximate the underside of the stage decks as well as unfolding with complicated bracing and maintaining the support from the legs. The inner support legs may use a short set and long set of legs for the two heights, with the short legs not foldable. In addition, the linkages often do not maintain the decks so that they properly align when in the use position. Furthermore, excessive loads pressed at the hinge point in the center of the two decks when in the unfolded position may cause the outer ends of the stage to lift. Furthermore, when the stage is folded in a substantially vertical position, the tops of the decks may come into contact with one another, having the potential to pinch users' hands or fingers.

It can be appreciated that a new and improved folding stage is needed which folds from a use position to a folded position with the tops of the decks substantially facing one another. Furthermore, it can be appreciated that a linkage is needed which controls the motion of the decks and provides proper alignment. Furthermore, the linkage should resist accidental folding and provides sufficient support for the legs so that greater loads may be applied. Moreover, the linkage should provide for legs which can extend to three different heights rather than only two. The present invention addresses these as well as other problems related to folding stages.

SUMMARY OF THE INVENTION

The present invention is directed to a mobile folding stage and in particular to a mobile folding elevationally adjustable stage. According to the present invention, a mobile folding stage has a pair of stage decks which are joined along a center axis to form a stage surface. The stage folds from a use position to a folded position wherein the stage decks are at a substantially vertical position with the upper surfaces of the decks facing one another. The stage includes a folding framework connected to a caster frame mounted on rollers or casters for moving the stage from location to location.

The stage includes a folding linkage which folds a framework and the stage decks from their horizontal use position to the nearly vertically folded storage position. In addition, the linkage connects to outer support legs which are folded between the use and non-use positions with actuating of the linkage. Inner legs fold to an extended position to provide additional support and to act as a pivot for the stage when folding between the folded position and the use position. Both the inner and outer legs are elevationally adjustable for changing the height of the stage. Each inner leg includes a foot having an angled portion which supports and guides the inner leg and the stage during the folding and unfolding operations. The inner legs also have guide brackets which engage an angled portion of the caster frame to direct the legs to their fully extended use positions. When the stage is folded, the inner and outer legs both lie substantially flat against the bottom of the stage decks.

The actuating linkage for folding includes a main mounting plate having raised end portions and a raised center portion. A substantially U-shaped link mounts from the raised center portion of the linkage mounting plate to the frame while a shortened link mounts from the end portion of the mounting plate to the frame. An extended link mounts from the linkage mounting plate to the outer leg to actuate folding the leg along with the folding of the stage. The substantially U-shaped link has a slight bevel at the top of the cross portion which receives the edge of the deck when in the folded position to angle the decks slightly toward one another. This resists accidental unfolding, but keeps a space between the upper edges of the decks so that users' hands and fingers cannot get pinched between the decks. Alignment pins on the edge of the decks also align with the corresponding bores on the opposite deck to guide alignment when in the use position.

The stage decks may be either permanently mounted or may be interchangeable or reversible. A spring engages a bore in one corner of the deck to slightly raise the corner of the decks when they are being removed or reversed. This provides for gripping one corner of the deck and easy reversal of the decks.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letter indicate corresponding elements throughout the several views.

DETAILED DESCRIPTION OF THE PREFERRED EMBODIMENT

Figure 1:
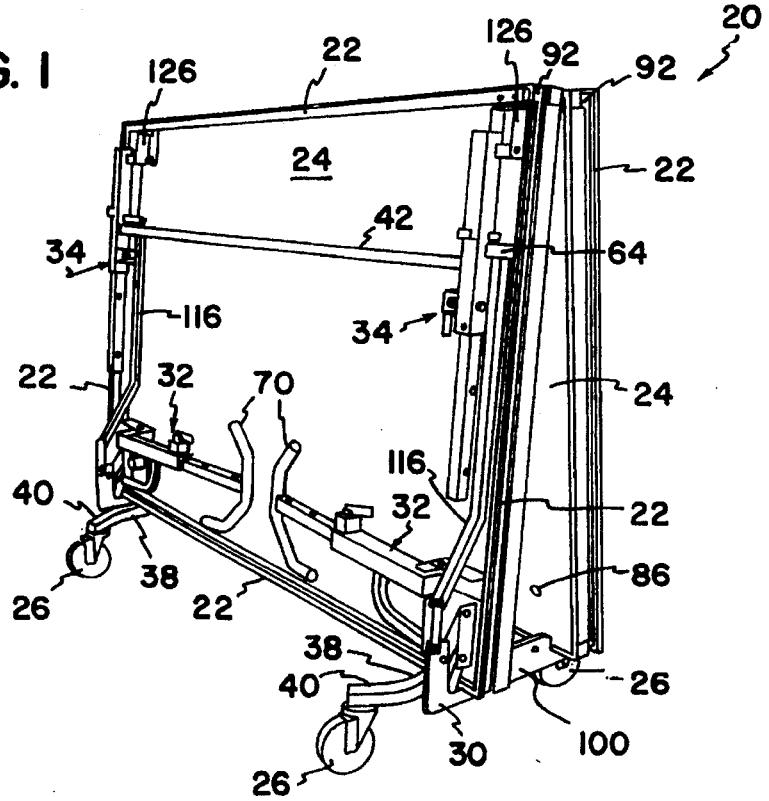
FIG. 1 shows a perspective view of a mobile folding stage in the folded position, according to the principles of the present invention.
Figure 2:
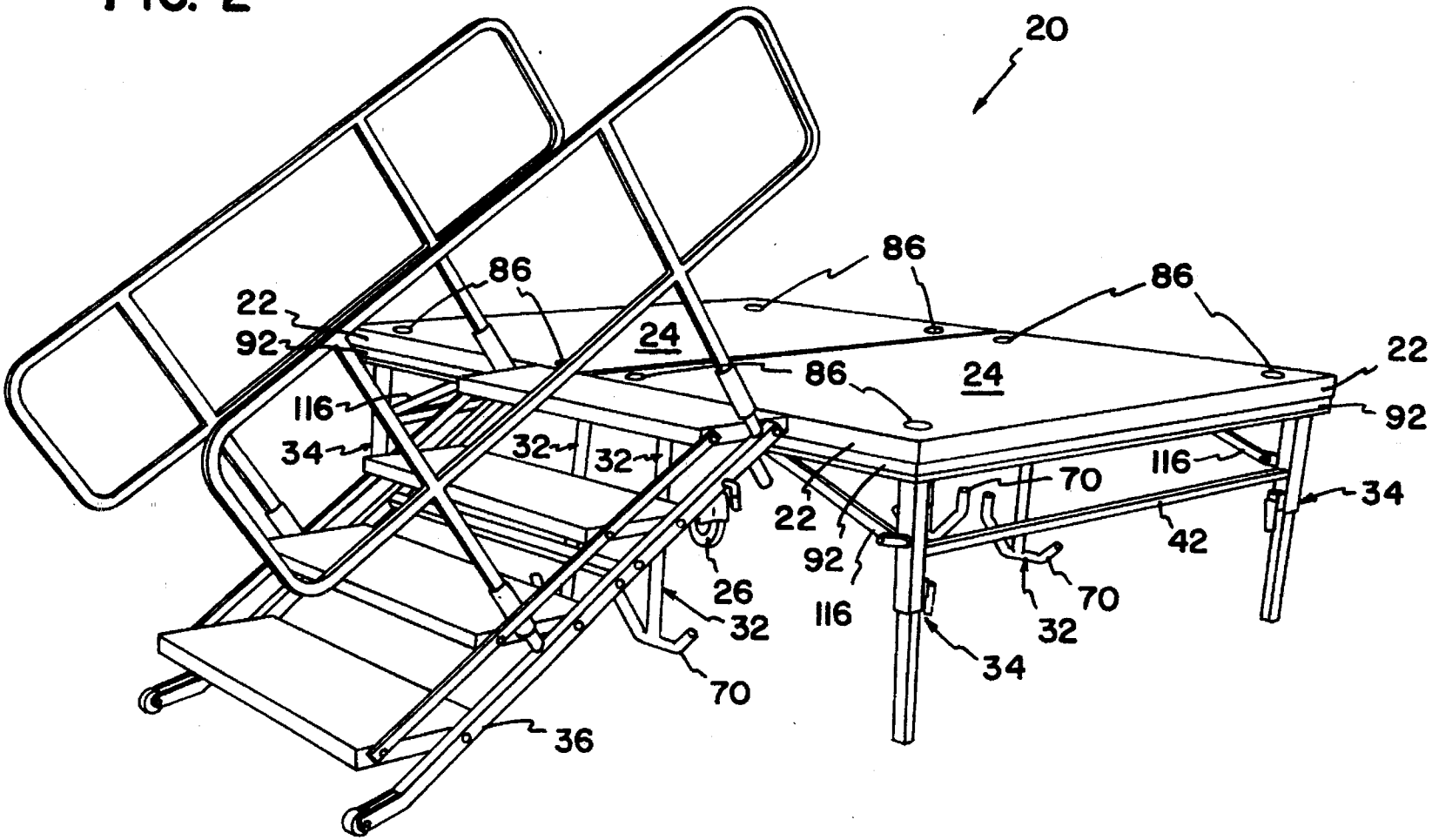
FIG. 2 shows a perspective view of the stage shown in FIG. 1 in the unfolded position with stairs attached.
Figure 4:
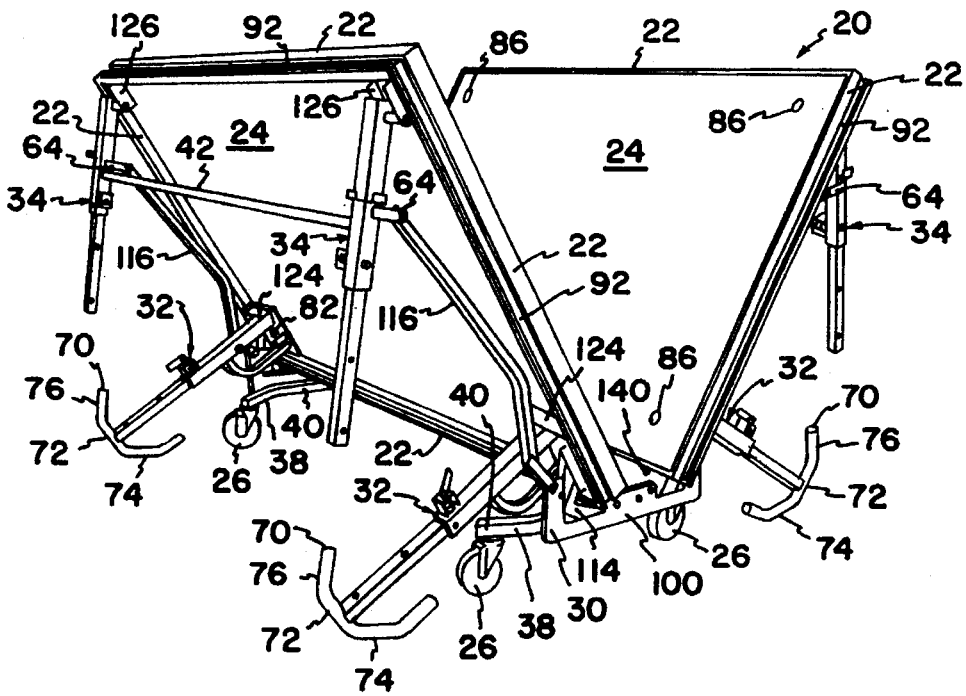
FIG. 4 shows a perspective view of the stage shown in FIG. 1 with the stage unfolded so that the inner legs are engaging the ground.

Referring now to the drawings and in particular to FIGS. 1 and 2, there is shown a mobile folding stage, generally designated 20. The stage 20 includes a folding frame 22 supporting a pair of decks 24. As shown in FIG. 1, in a folded storage position, the decks 24 are positioned just past vertical with upper faces of the decks 24 opposing one another. As shown in FIG. 2, when the stage 20 is unfolded, the decks 24 form an extended planar stage surface. The stage 20 is supported on inner legs 32 and outer legs 34 which extend to a support position as shown in FIG. 2. When the stage 20 is folded, as shown in FIG. 1, the inner legs 32 and outer legs 34 fold to a position lying substantially flat against the lower surfaces of the stage decks 24.

As shown in FIG. 1, the stage 20 is rolled on casters or rollers 26 which are mounted on a caster frame 38. The caster frame 38 has a center cross member running substantially along the folding axis of the stage 20 and end members extending substantially perpendicular to the center axial member. End portions 40 of the perpendicular members are angled slightly inward from the edge of the stage to aid in alignment of the inner legs 32 during unfolding, as explained hereinafter.

The decks 24 may be permanently attached to the folding frame 22 or may be reversible or removable to provide a variety of deck surfaces for different uses. In addition, the decks 24 and frame 22 are configured with attachment members 90, as shown most clearly in FIGS. 14 and 15, which provide for attaching to other similar stages or for decks 24 being supported between stages 20 for forming an expanded extended stage surface with fewer stages. Curtains or other decorative accessories may be hung from a mounting strip 92 along the edge of the decks 24. In addition, as shown in FIG. 2, removable stairs 36 may be mounted to an edge of the stage 20 to provide easier access to the stage. In addition, guard rails and other safety equipment may also be mounted to provide greater flexibility for configuring the stage 20.

Figure 3:
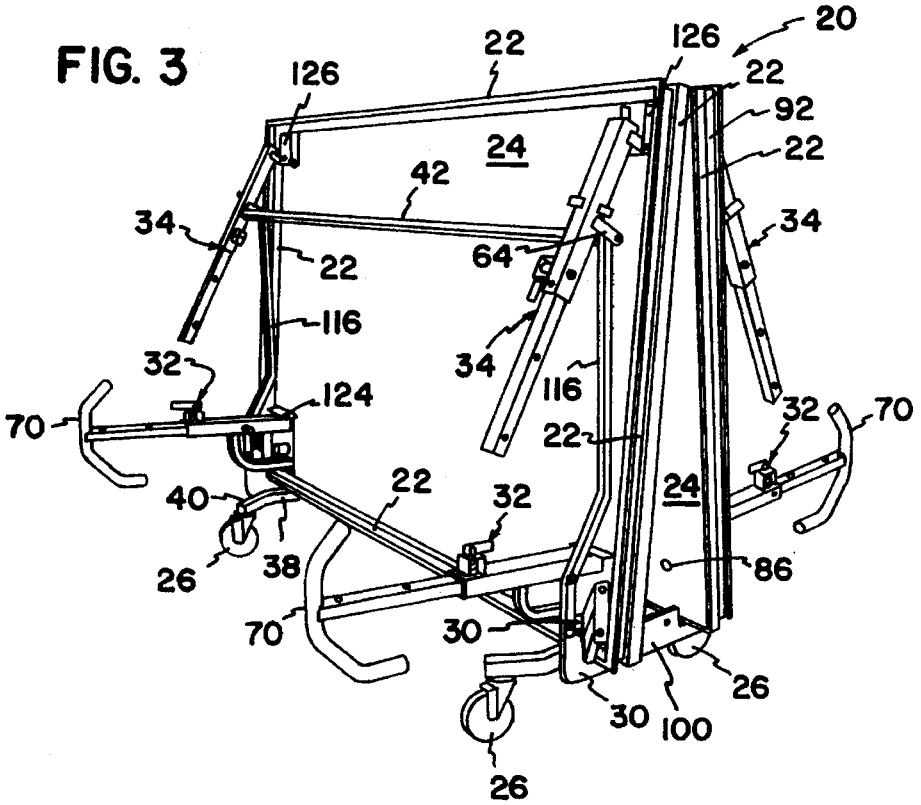
FIG. 3 shows a perspective view of the stage shown in FIG. 1 partially unfolded.
Figure 14:
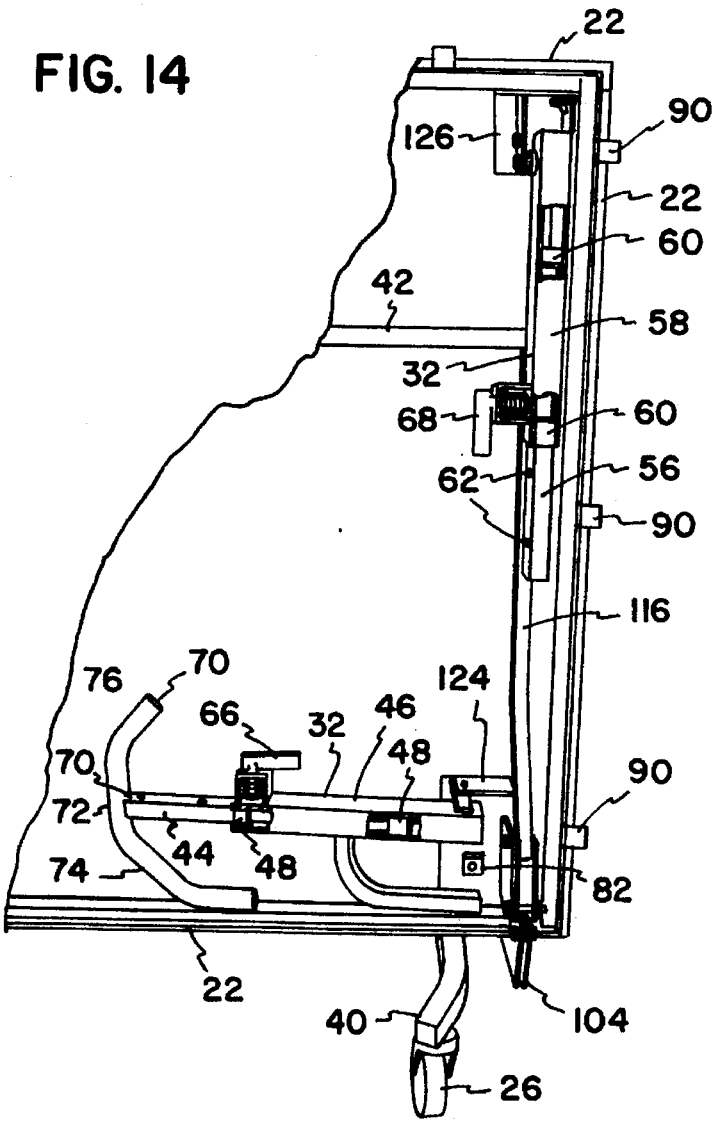
FIG. 14 shows a side elevational view of the outer leg and linkage for the stage shown in FIG. 1.

As shown most clearly in FIGS. 1, 3 and 14, the outer legs 34 include a telescoping leg portion 56 and outer leg member 58. The telescoping member 56 includes height adjustment holes 62 which engage a spring loaded pin 68 having a handle attached thereto. A pin 68 inserts into the hole 62 to maintain the leg 34 at a desired height. In the preferred embodiment, each of the outer support legs 34 has three different adjustment holes 62 for maintaining the stage 20 at one of three different heights. As shown in FIG. 14, the legs 34 include spacers 60 having a substantially rectangular configuration extending between the outer leg member 58 and the telescoping member 56 to provide easy sliding between the members 56 and 58 and to provide solid support with little relative movement between the outer member 58 and telescoping inner member 56. As shown more clearly in FIGS. 1 and 3, each of the outer legs 34 includes a strut 64 which connects to the folding linkage 30, as explained hereinafter. A cross member 42 extends between the pair of the outer legs 34 on the underside of each deck 24. In addition, as shown in FIG. 14, the legs pivot on a mounting plate 126 which provides for direct support to the frame 22 by the framework on the outer legs 34 when in the use position.

Referring to FIG. 14, the inner support legs 32 include an outer member 46 and an inner telescoping member 44 for varying the height of the inner legs 32. The telescoping member 44 includes height adjustment holes 50 which receive a spring loaded pin 66 which inserts into the height adjustment holes 50 to maintain the telescoping member 44 at a desired height. Rectangular spacers 48 insert between the outer member 46 and the telescoping member 44 for providing easy sliding between the members while also providing increased support and stability to the inner legs 32. The inner legs 32 pivot about a bracket 124 mounting to the frame 22. When in the extended position, the inner legs 32 carry the load directly from the frame 22 through the legs 32.

Since the inner legs 32 support the decks 24 and the entire stage 20 during folding and unfolding, the inner legs 32 include feet 70 which are configured for aiding and supporting the legs 32 and stage 20 during folding and unfolding, as explained hereinafter. Each of the feet 70 includes a flat bottom portion 72 and an inner angled portion 74 which extends at a substantially 45° angle upward from the bottom portion 72 in the preferred embodiment and then extends upward at a second 45° bend. In addition, the feet 70 include an angled outer portion 76 extending away from the folding axis of the stage 20. In the preferred embodiment, the outer portion 76 is angled at a 45° angle from the bottom portion 72. The configuration of the feet 70 provides for pivoting while also maintaining an increased contact area between the feet 70 and the ground. In addition, the feet 70 act as skids allowing for some sliding to take place during folding and unfolding the stage 20.

Figure 10:
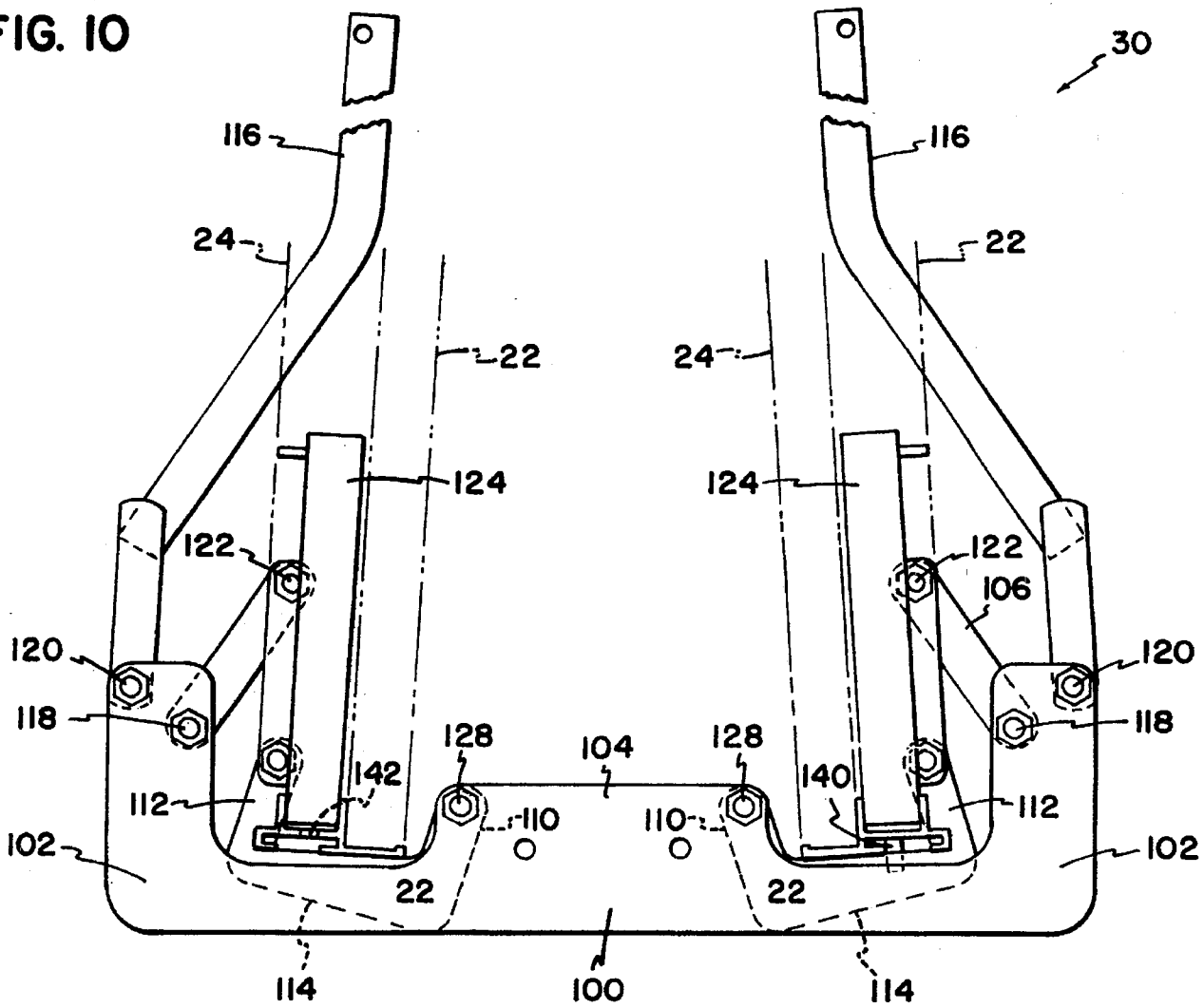
FIG. 10 shows a side elevational view of the folding linkage for the stage shown in FIG. 1 in the folded position.
Figure 11:
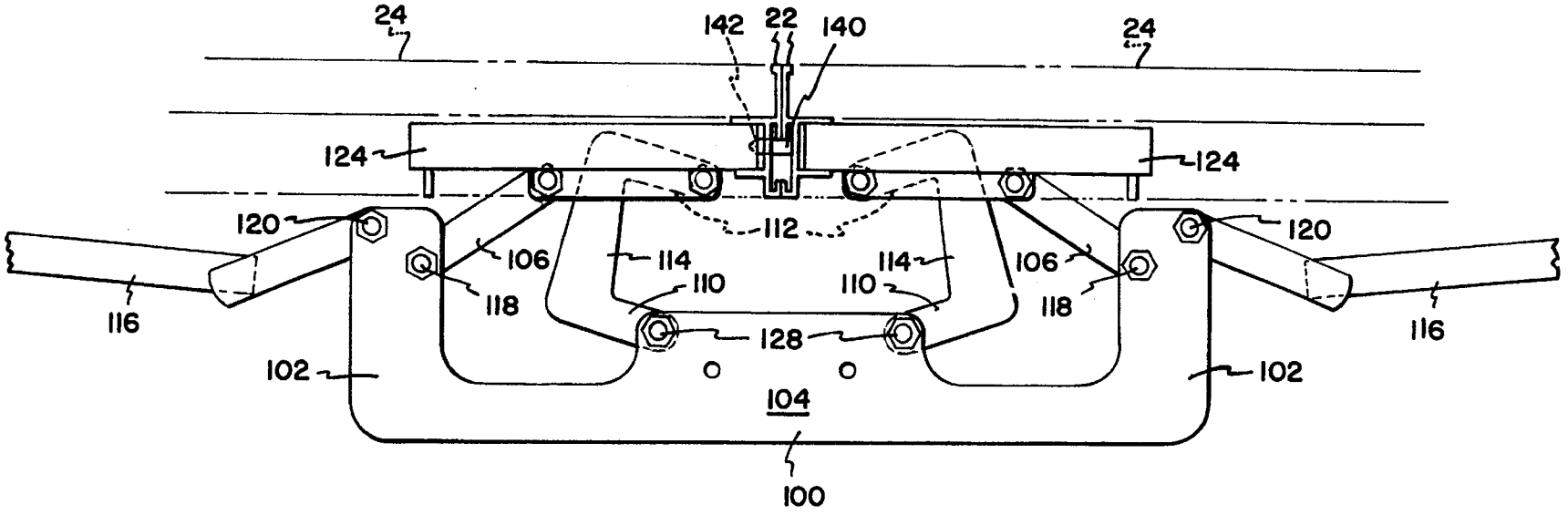
FIG. 11 shows a side elevational view of the folding linkage shown in FIG. 10 in the unfolded position.

As shown most clearly in FIGS. 10 and 11, the folding linkage 30 provides for folding of the stage decks 24 from a flat use position to a folded storage position. The linkage 30 includes a main linkage mounting plate 100 at each end of the decks which attaches to end members of the caster frame 38. The linkage mounting plate 100 includes raised end portions 102 which extend vertically upward at each end of the mounting plate 100. A raised center portion 104 is positioned intermediate the end portions 102. Therefor, each end portion 102 forms a channel with the center portion 104 which supports ends of the decks 24 when in the folded position. The linkage 30 further includes a substantially horseshoe shaped link 108 which mounts from a pivot point 128 at the center portion 104 of the main plate 100. The U-shaped link 108 includes a first side portion 110 and a second side portion 112 connected by an angled bottom portion 114. The bottom portion 114 includes a beveled upper surface which receives and supports the edge of the deck 24 when the stage 20 is folded. The bevel of the bottom portion 114 tilts the stage deck 24 slightly past vertical toward the center axis to aid in resisting accidental unfolding of the stage 20 when in the folded position. The first side portion 110 mounts to the mounting bracket 124 on the frame 22 at pivot point 128. In addition, a short link 106 mounts to the mounting bracket 124 at pivot point 122 and also to the end portion 102 of the main plate at a pivot point 118. An extended link 116 which jogs toward the frame to lie substantially flat against the bottom of the deck 124 in the folded position extends to the strut 64 on the outer leg 34 as shown in FIG. 14. The extended link 116 mounts at a pivot point 120 at an outer position of the end portion 102.

The decks 24 include pins 140 engaging corresponding bores along the inner edges of the decks 24 to guide and align the decks along the center axis.

It can be appreciated that with this arrangement, the linkage 30 folds the stage deck 24 and outer legs 34 from a folded position as shown in FIG. 1 to a use position, as shown in FIG. 2, and then back to a folded position. The linkage 30 provides for greater stability so that when in the use position, a load placed at the direct center of the stage 20 cannot cause the decks 24 to fold up. In addition, the linkage provides for slightly raising the inner edges of the decks 24 when folding the stage 20 so that the decks 24 have room to fold and unfold without binding upon one another or the linkage 30. Furthermore, the linkage 30 is designed so that the stage decks 24 are in a just past vertical position when folded, so that they resist accidental unfolding, yet are spaced slightly apart at their top edge so that operators' and users' hands will not be pinched between the tops of the decks 24. Furthermore, the linkage 30 also folds the outer legs 34 from a folded position to an extended position wherein they are directly supporting the stage frame 22. The linkage 30 actuates the outer legs 34 so that the outer legs 34 are substantially flat against the bottom of the decks 24 when folded and so that the extended link 116 is also substantially flat against the deck 24 when folded with only end portions extending to engage the linkage 30.

Figure 5:
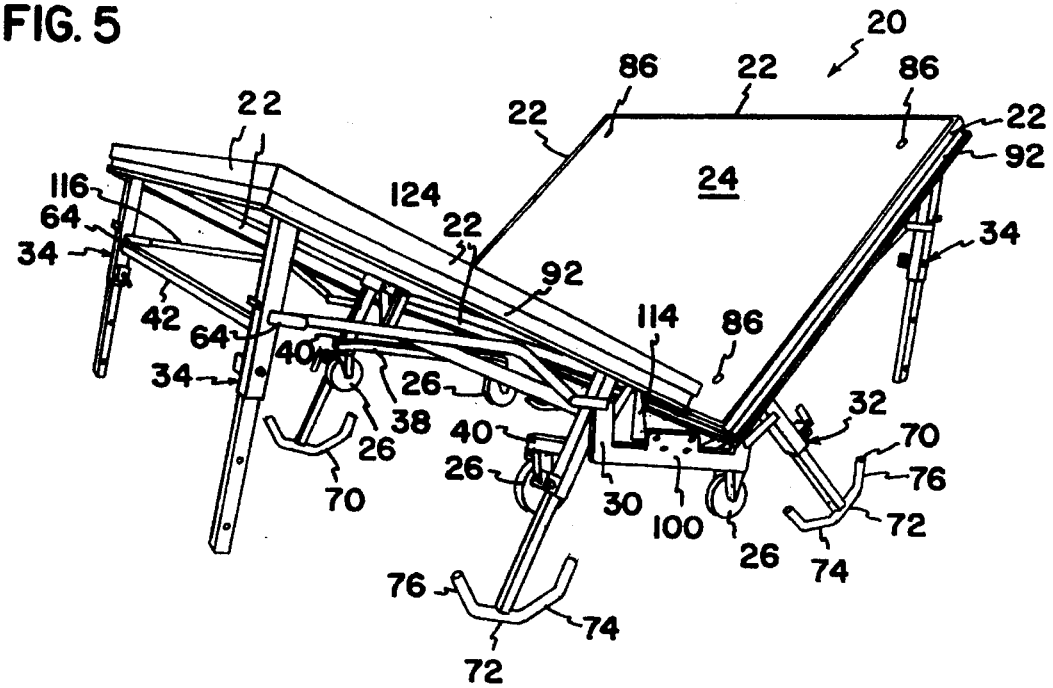
FIG. 5 shows a perspective view of the stage shown in FIG. 1 folded so that the stage is pivoting on its inner legs.

The operation of unfolding the stage is shown in FIGS. 1 and 3–7. Referring to FIG. 1, when the stage 20 is folded, the decks 24 are substantially vertical and extending slightly towards one another. The legs 32 and 34 are typically in a folded position stored flat against the bottom of the decks 24. The stage 20 is supported on the casters 26 and may be easily rolled to a desired location. To begin unfolding, the outer legs 34 are pulled outward away from the bottoms of the decks 24, as shown in FIG. 3. The linkage 30 passes through a toggle point, so that the legs 34 slightly "snap" outward with the linkage 30 and the extended links 116 also move slightly outward from the bottoms of the decks 24. In addition, the inner legs 32 are folded outward to their fully extended position, as also shown in FIG. 3. As the stage continues to unfold, with the decks 24 lowering, the feet 70 of the inner legs 32 engage the floor. At the position shown in FIG. 4, the inner portion 74 has its angled surface substantially flat against the floor. At the point wherein the stages are supported on the inner portion 74 of the foot 70 the outer legs 34 become slightly more extended. As the unfolding continues and the decks 24 are lowered further, the stage 20 pivots about the bend between the bottom portion 72 and the angled inner portion 74 of the feet 70. At this point, the caster frame 38 and the casters 26 are lifted upward so that the casters 26 are no longer engaging the floor and the stage 20 is supported entirely on the inner legs 32. The linkage 30 also extends the outer legs 34 slightly more, as shown in FIG. 5. The inner edges of the decks 24 are also moved slightly closer to facing one another.

Figure 6:
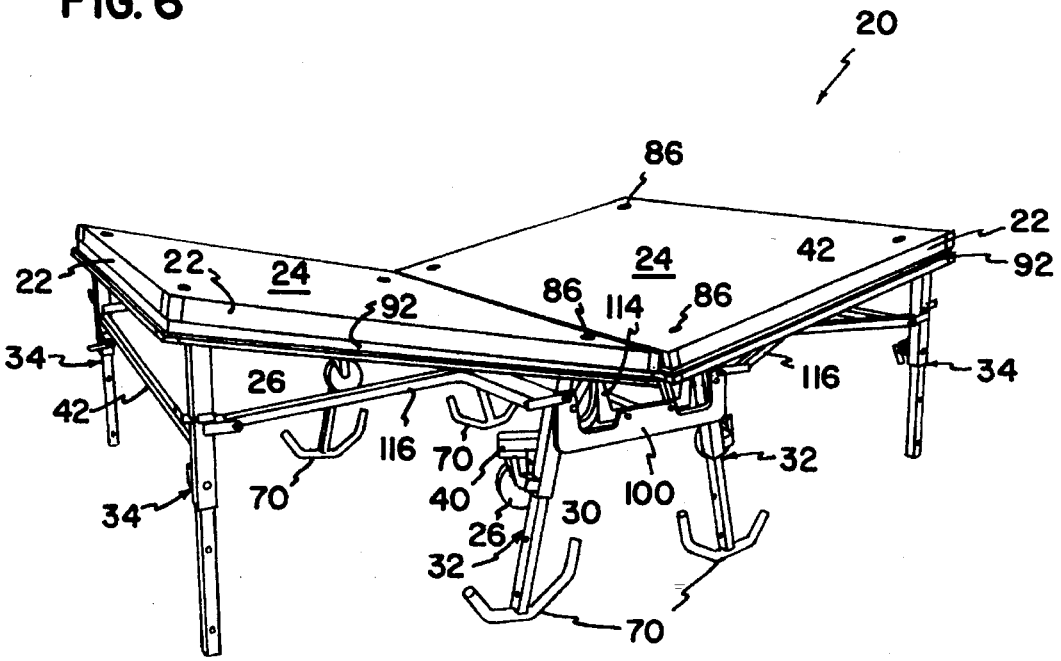
FIG. 6 shows a perspective view of the stage shown in FIG. 1 in a nearly unfolded position.
Figure 7:
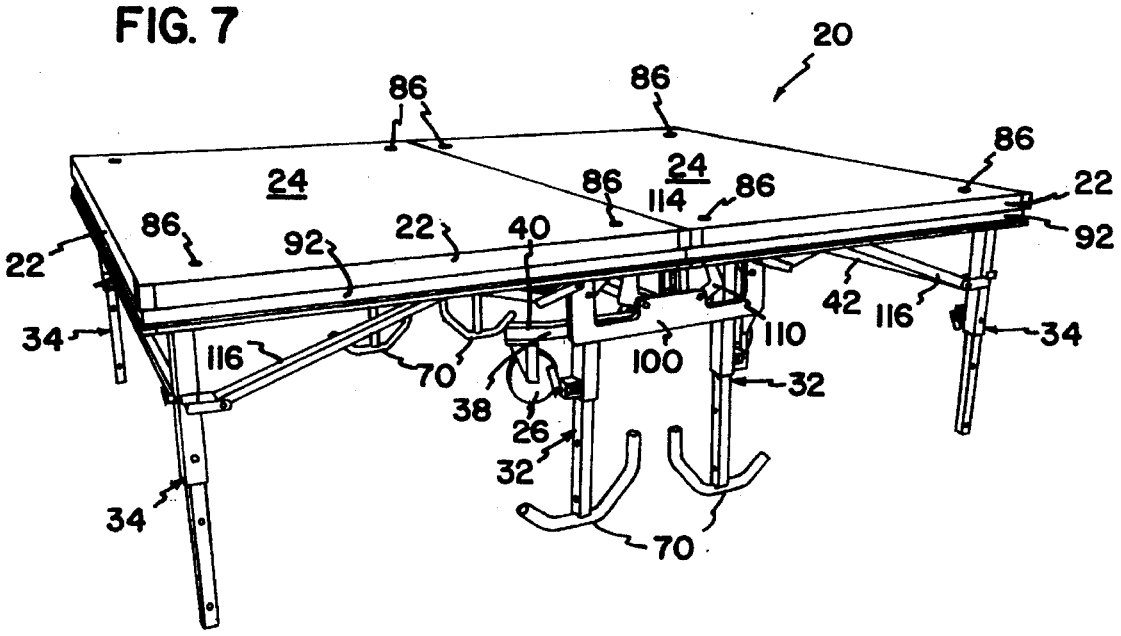
FIG. 7 shows a perspective view of the stage shown in FIG. 1 with the stage unfolded.

As shown in FIG. 6, as the unfolding continues, the inner legs 32 are substantially supported on the bottom portion 72 of the feet 70. The outer legs 34 are almost entirely perpendicular to the stage decks 24 and the inner edges of the decks 24 substantially face one another. With further folding, the edges of the decks 24 entirely face one another and engage with alignment pins 140 engaging opposed complimentary bores 142 along the inner edges of the decks 24, as shown in FIG. 11. When the stage is entirely unfolded, as shown in FIG. 7, the load is supported directly through the inner and outer legs 32 and 34 for increased stability and support.

Figure 8:
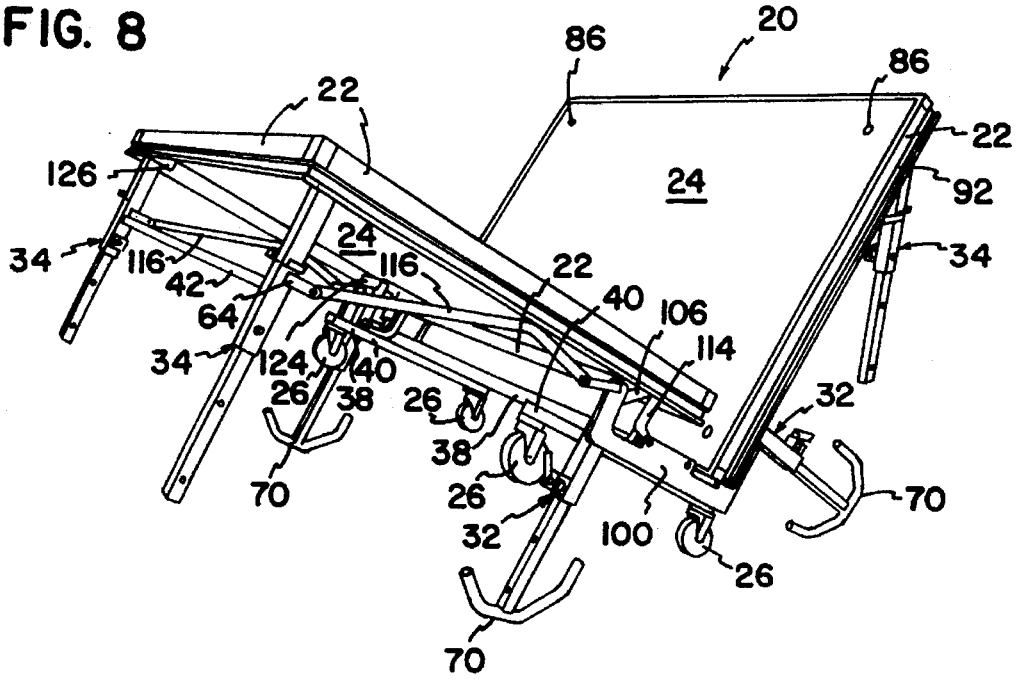
FIG. 8 shows a perspective view of the stage shown in FIG. 7 in a partially folded position.
Figure 9:
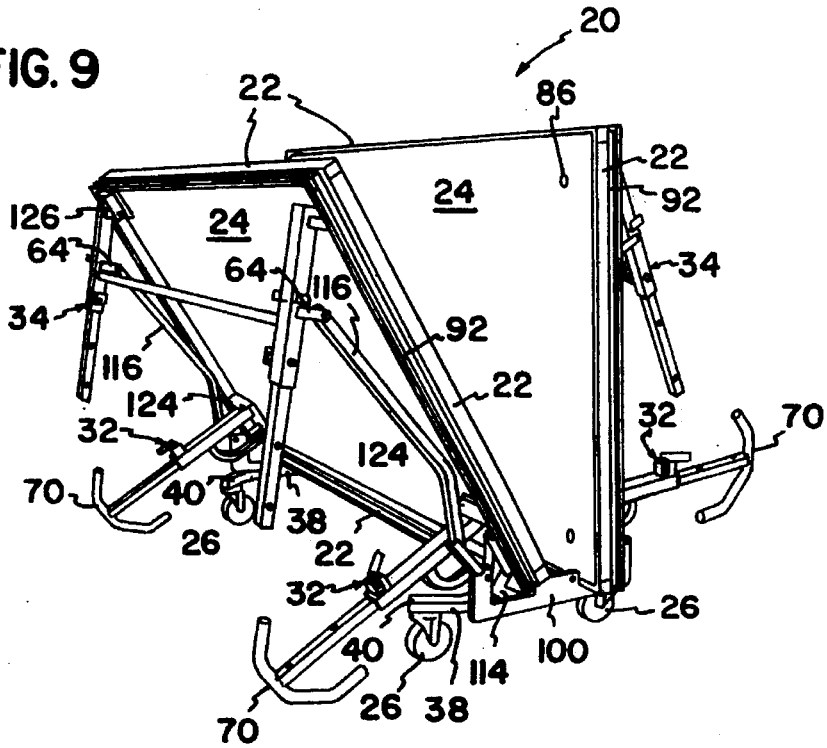
FIG. 9 shows a perspective view of the stage shown in FIG. 7 in a nearly folded position.

To fold the stage 20, the steps are substantially reversed with some slight variations. As shown in FIG. 8, as the stage decks 24 are lifted towards one another, the stage 20 will be supported on the feet 70 and substantially on the inner portions of the feet 74. One deck 24 will typically be lowered before the other so that at least one set of the casters 26 engages the ground. At this point, the second deck 24 will be folded so that both sets of casters 26 will engage the ground. One deck 24 is lifted upward, as shown in FIG. 9, to the substantially folded position. Then the second deck 24 can be folded upwards so that both decks are substantially folded, as shown in FIG. 3. The legs 32 and 34 are then refolded to the original storage position, shown in FIG. 1.

Figure 12:
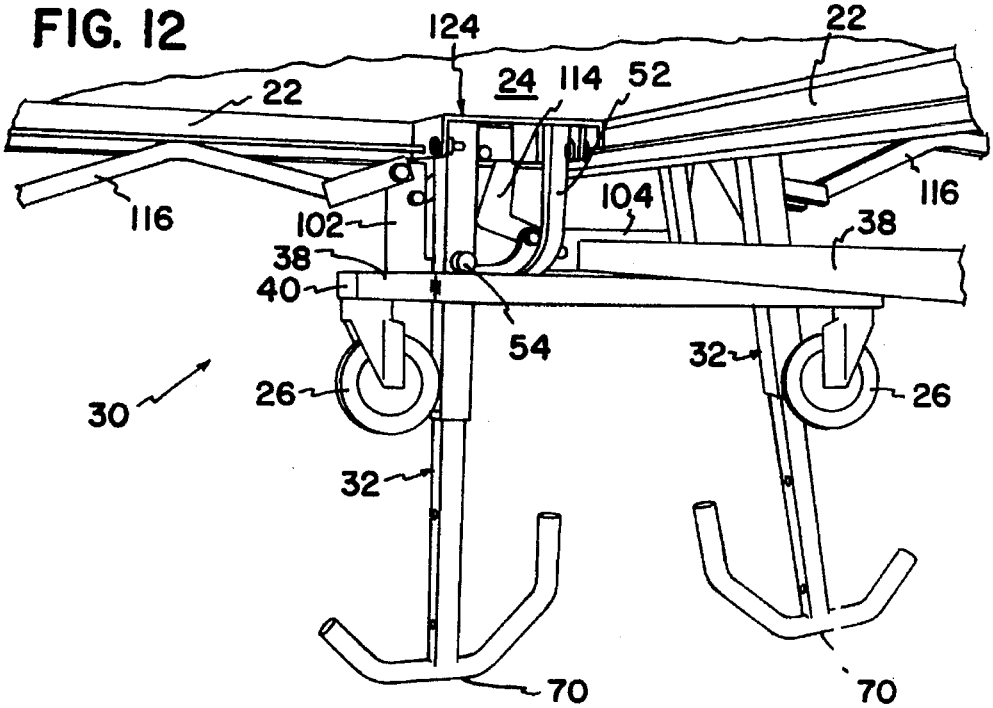
FIG. 12 shows an internal perspective view of the inner support legs and linkage.
Figure 13:
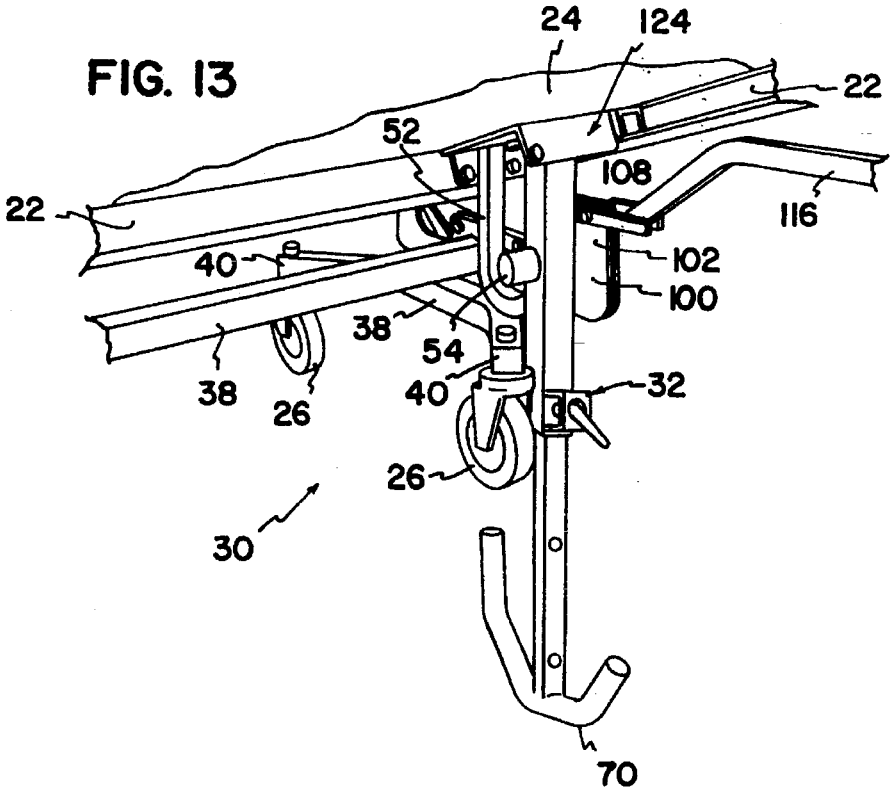
FIG. 13 shows a perspective view of the inner leg and guide bracket engaging the caster frame to direct the leg to an unfolded position.

Referring to FIG. 12, when the stage is unfolded, the inner leg 32 includes a support member 54 which substantially rests against the perpendicular end portion of the caster frame 38. This provides increased stability and directs the load substantially through the leg 32. In addition, on an inner portion of the inner legs 32 there is mounted a guide bracket 52. As shown in FIG. 13, the guide bracket has a curved profile which may engage the bent end portions 40 of the caster frame 38 if the inner leg 32 is not fully unfolded or is misaligned while unfolding the stage 20. If the inner leg 32 is not entirely moved from its folded storage position and is still slightly folded, as the stage 20 is unfolded, the guide bracket 52 will engage the angled end portions of the caster frame 40 and move the leg 32 outward toward its proper support position for supporting the stage 20. It can be appreciated that as the stage 20 is unfolded more, the guide bracket 52 pushes the leg 32 outward along the angled portion 40 so that it is forced into its extended support position perpendicular to the deck 24. In this manner, the guide bracket 52 and the angled end portion 40 of the caster frame 38 guide and align the inner legs 32.

Figure 15:
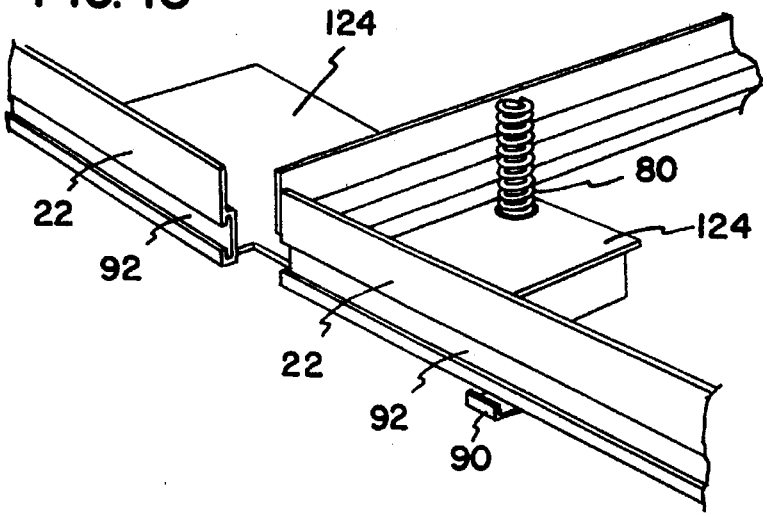
FIG. 15 shows a perspective view of a mounting spring for the deck connectors for the stage shown in FIG. 1, and, FIG. 16 shows a perspective view of a deck being raised at one corner by the spring shown in FIG. 15.
Figure 16:
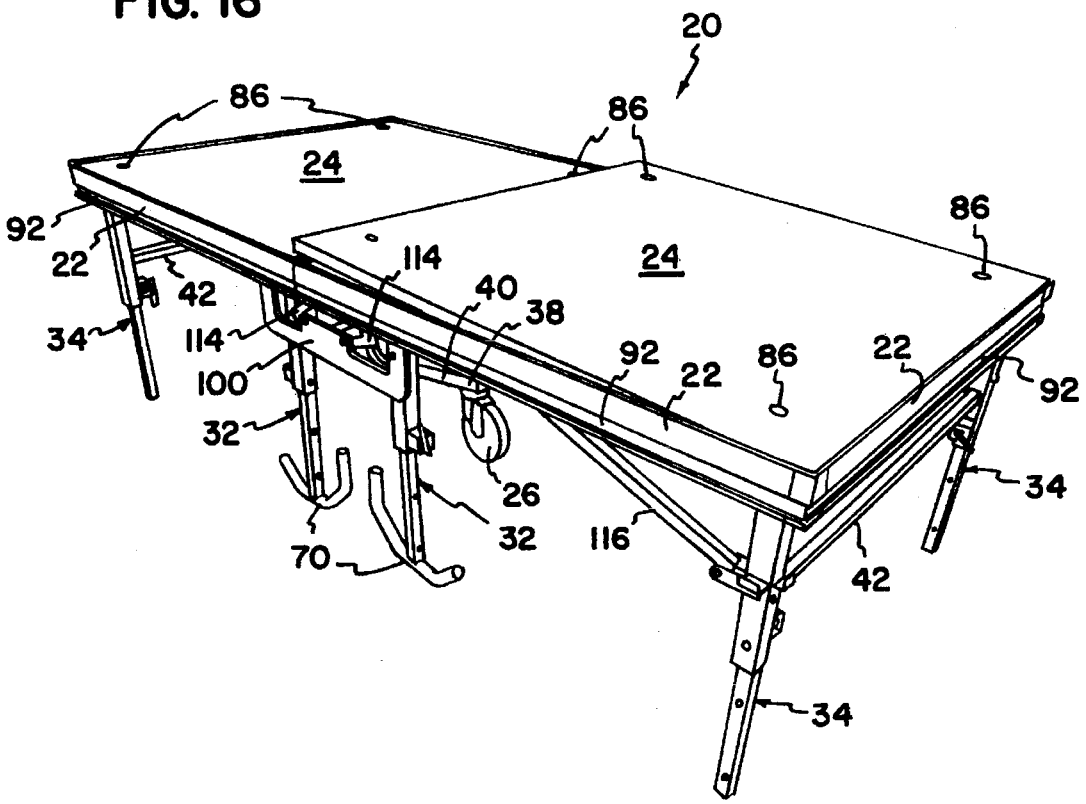

The attachment system for supporting the decks 24 to the frame 22 is shown in FIGS. 15 and 16. The decks 24 include orifices along their lower portion which are hidden beneath a captive nut 82, as shown most clearly in FIG. 14. The captive nut 82 connects to a bolt 86 attaching through the orifices in the bottom of the deck 24. However, at one of the corners, a spring 80 will be placed to help raise the decks when removing or flipping the deck members 24. The spring 80 helps to raise one corner of the decks 24, as shown in FIG. 16. When the bolt 86 is loosened, the spring 80 forces the one corner of the deck 24 upward so that it may be grabbed by the fingers, allowing easier lifting of the remaining corners of the deck 24. In this manner, the decks 24 may be more easily removed and with less chance of fingers being pinched while trying to lift the decks 24.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A mobile folding stage, comprising:

a frame;

stage decks mounting to the frame and forming an extended stage surface;

a linkage folding the stage along a center axis from a use position wherein the stage decks are substantially horizontal to a folded position wherein the decks are substantially vertical with the stage surfaces facing one another;

inner support legs and outer support legs, wherein the inner support legs fold to a storage position lying substantially against undersides of the stage decks and wherein the inner support legs are actuable independently from the linkage, and wherein each of the inner support legs includes a floor engaging portion having a substantially horizontal bottom portion and an end portion having a planar lower surface extending upward from the bottom portion at an angle of less than 90 degrees and more than zero degrees.

2. A mobile folding stage according to claim 1, wherein the linkage folds the outer legs to a folded position substantially flat against undersides of the decks.

3. A mobile folding stage according to claim 1, further comprising a caster frame having an angled end portion engaging a guide bracket on each of the inner support legs to guide the inner support legs during unfolding of the stage.

4. A mobile folding stage according to claim 1, wherein the linkage comprises a first link member having a raised center portion and end portions extending upward and wherein the stage decks fold to a substantially vertical position wherein ends of the decks rest between the center portion and the end portions in the folded position.

5. A mobile folding stage according to claim 4, wherein the linkage further comprises a U-shaped second link pivotally connecting to the frame and the raised center portion of the first link, and a third link pivotally connecting to the frame and the end portion of the first link, and a fourth link pivotally connecting to the end portion of the first link and to the leg.

6. A mobile stage according to claim 1, wherein the end portion extends inward toward the center axis.

7. A mobile folding stage according to claim 1, wherein the inner and outer support legs are independently elevationally adjustable to three different heights.

8. A mobile folding stage according to claim 1, wherein the inner support legs include a support member extending from each of the inner support legs engaging an upper surface of the frame in the unfolded position.

9. A mobile folding stage according to claim 1, further comprising a lift spring positioned intermediate the frame and a corner of the deck, wherein upon detaching the deck from the frame, the lift spring raises the corner of the deck.

10. A mobile folding stage according to claim 9, further comprising bolts attaching the decks to the frame and wherein the lift spring mounts to a mounting plate above a support leg.

11. A mobile folding stage according to claim 1, wherein the inner support legs and the outer support legs comprise telescoping members adjustably extending from upper leg members.

12. A mobile folding stage according to claim 11, wherein the telescoping members and the upper leg members are substantially rectangular, and wherein the inner support legs and outer support legs further comprise rectangular spacers intermediate the telescoping member and the upper leg member.

13. A stage according to claim 1, wherein the inner support legs mount so as to engage an underside of the frame, whereby loads to the frame pass directly through the frame and the inner support legs.

14. A stage according to claim 13, wherein the outer support legs mount so as to engage an underside of the frame, whereby loads to the frame pass directly through the frame and the outer support legs.

15. A mobile folding stage having a folding linkage, comprising:

a) stage deck;

b) an outer leg mounting to the stage deck and folding from a use position wherein the leg extends at a substantially right angle to the stage deck and a folded position extending proximate the stage deck;

c) a first main link having raised end portions and a raised center portion;

d) a substantially U-shaped second link pivotally mounting at a first end to the raised center portion and at a second end to the deck;

e) a third link pivotally mounting at a first end to the raised end portion and at a second end to the deck; and, f) a fourth link pivotally connected to the raised end portion of the main link and to the outer leg.

16. A mobile folding stage, comprising:

a pair of decks folding along a center axis;

a folding linkage to facilitate folding;

a caster frame including end members having an angled end portion;

inner legs folding from an extended use position to a folded position substantially flat against the stage; wherein each of the inner legs include a guide bracket extending from the leg and wherein the guide bracket engages the angled portion of the caster frame when the stage is unfolded and the leg is not fully extended to guide the leg to a fully extended position.

17. A mobile folding stage according to claim 16, further comprising a support extending from the side of each of the inner legs, wherein the support rests on an upper surface of the caster frame to provide additional support to the inner legs.

18. A mobile folding stage according to claim 17, wherein each of the inner support legs includes a floor engaging portion having a substantially horizontal bottom portion and an end portion extending upward from the bottom portion at an angle of less than 90° and more than zero degrees.

19. A mobile folding stage, comprising:

a frame;

stage decks mounting to the frame and forming an extended stage surface;

inner support legs and outer support legs;

a linkage folding the stage along a center axis from a use position wherein the stage decks are substantially horizontal to a folded position wherein the decks are substantially vertical with the stage surfaces facing one another; and, a caster frame having an angled end portion engaging a guide bracket on each of the inner support legs to guide the inner support legs during unfolding of the stage.

20. A mobile folding stage, comprising:

a frame;

stage decks mounting to the frame and forming an extended stage surface;

inner support legs and outer support legs;

a linkage folding the stage along a center axis from a use position wherein the stage decks are substantially horizontal to a folded position wherein the decks are substantially vertical with the stage surfaces facing one another;

wherein the linkage comprises a first link member having a raised center portion and end portions extending upward and wherein the stage decks fold to a substantially vertical position wherein ends of the decks rest between the center portion and the end portions in the folded position, a U-shaped second link pivotally connecting to the frame and the raised center portion of the first link, a third link pivotally connecting to the frame and the end portion of the first link, and a fourth link pivotally connecting to the end portion of the first link and to the leg.

21. A mobile folding stage, comprising:

a frame;

stage decks mounting to the frame and forming an extended stage surface;

a lift spring positioned intermediate the frame and a corner of one of the decks, wherein upon detaching the deck from the frame, the lift spring raises the corner of the deck;

inner support legs and outer support legs; and, a linkage folding the stage along a center axis from a use position wherein the stage decks are substantially horizontal to a folded position wherein the decks are substantially vertical with the stage surfaces facing one another.

22. A mobile folding stage, comprising:

a frame;

stage decks mounting to the frame and forming an extended stage surface;

a linkage folding the stage along a center axis from a use position wherein the stage decks are substantially horizontal to a folded position wherein the decks are substantially vertical with the stage surfaces facing one another;

inner support legs and outer support legs, wherein each of the inner support legs includes a floor engaging portion having a substantially horizontal bottom portion and an end portion having a planar lower surface extending upward from the bottom portion at an angle of less than 90 degrees and more than zero degrees.

* * * * *